United States Patent [19]

Mayer et al.

[11] 3,990,068

[45] Nov. 2, 1976

[54] PLASMA DISPLAY PANEL DRIVE SYSTEM

[75] Inventors: William N. Mayer; Nicholas C. Andreadakis, both of White Bear Lake, Minn.

[73] Assignee: Control Data Corporation, Minneapolis, Minn.

[22] Filed: Jan. 26, 1976

[21] Appl. No.: 652,434

[52] U.S. Cl. ..... 340/324 M; 313/217; 313/220; 315/169 R; 340/166 EL; 340/173 PL; 340/343

[51] Int. Cl.[2] ..... H01J 17/48

[58] Field of Search ... 340/324 M, 173 PL, 166 EL; 315/169 R, 169 TV; 313/217, 220

[56] References Cited

UNITED STATES PATENTS

| | | | |
|---|---|---|---|
| 3,509,408 | 4/1970 | Holz | 313/220 X |
| 3,531,685 | 9/1970 | Holz | 313/220 X |
| 3,803,586 | 4/1974 | Johanns et al. | 340/324 M |
| 3,846,656 | 11/1974 | Schermerhorn | 313/220 X |
| 3,925,703 | 12/1975 | Schermerhorn | 315/169 TV |
| 3,927,342 | 12/1975 | Bode et al. | 313/220 X |
| 3,969,651 | 7/1976 | Greeson | 313/217 X |

*Primary Examiner*—David L. Trafton
*Attorney, Agent, or Firm*—William J. McGinnis, Jr.

[57] ABSTRACT

In a plasma display panel, of a conventional type or of the planar type, a drive system consists of an array of paired, parallel drive lines, both of which may be on the same side of the enclosed gas atmosphere, as with the planar panel, or disposed on opposite sides of the enclosed gas atmosphere, and a second array, orthogonal to the first, of paired parallel write/erase trigger lines. The parallel drive lines are driven continuously with a sustain voltage drive signal. The trigger lines are selectively driven in conjunction with a selected pair of the paired drive lines to write or erase a selected display element.

4 Claims, 3 Drawing Figures

PLASMA DISPLAY PANEL DRIVE SYSTEM

BACKGROUND OF THE INVENTION

This invention relates to drive systems for gaseous discharge plasma displays.

Generally, prior art plasma display drive systems have been based on a matrix concept involving a pair of arrays having parallel conductors with the arrays disposed orthogonally to one another and having the gaseous medium therebetween so that selection of one drive line conductor from each array uniquely specifies any selected display element in the panel. Because of the matrix characteristic of this prior art, connections to such panels and associated line selection circuitry are extremely complex since each drive line in both arrays must be uniquely selectable. The ability to select a given drive line conductor requires a substantial number of associated passive and active line components, such as resistors, capacitors, diodes and transistors in order to respond to activating signals from the required logic circuitry.

SUMMARY OF THE INVENTION

The present invention comprises a simplified plasma display drive system requiring fewer individual drive line components than prior art systems. A plasma display panel incorporating the present drive system is constructed with an array of parallel paired sustain drive lines and a second array orthogonal to the first of paired parallel write/erase drive lines and in which the display elements of the panel are defined by the intersections of the pairs of sustain lines and the pairs of write/erase lines.

One form of this invention is used with what is called a capillary tube plasma display in which the gaseous display medium is confined in a plurality of capillary tubes arranged parallel to one another in a close pattern. Thus, the sustain lines may be exactly parallel to one another on one surface of the panel and running orthogonally with respect to the capillary tubes. Once a given display cell is in a lighted condition the lit display element is confined in one direction by the walls of the capillary tube and bounded in the other direction by one or the other of the two of the pair of sustain lines. In such a panel, the write/erase lines run with the capillary tubes in a parallel fashion and one pair of write/erase lines is associated with each individual capillary tube.

In the form of the invention in which this drive line system is incorporated in a planar plasma display panel of the type in which all drive element electrodes are deposited on a substrate with interleaved layers of dielectric. In the presently existing form of planar plasma display panels, the matrix of orthogonal drive lines defines the individual display elements at the intersection of the orthogonal drive lines. In the form of the present invention used with a planar panel, there would be several alternative ways of defining the individual display elements. One such way would involve placing ridges or barriers orthogonally to the pairs of sustain drive lines such that the ionized portion of the gaseous display would not be able to travel over the ridges or barriers deposited across the sustain lines. These barriers would then prevent the ionized display to travel the length of the parallel paired sustain lines and in effect light an entire row when it was only desired to light a given spot. Another way of achieving this objective would be to deposit the drive lines so that at areas on the display surface where it was desired to define a display element, the drive lines would lie much closer to one another than at points between the display elements. In effect, the paired sustain lines would form a zig-zag pattern with the lines coming closer together at display elements and diverging away from one another between display elements. This would allow a higher voltage to develop at display elements thus maintaining the ionized condition of a display element but not providing sufficient charge on the dielectric surface of the planar panel to cause the lighted display or the ionized gas associated therewith to travel down in an individual row.

Writing is accomplished by selecting a sustain voltage between two sustain drive lines and then firing a small discharge in the edge of the defined display element area of the selected row. This small discharge is driven by the write/erase drive lines and triggers the lighting of the display elements only where the sustain voltage is simultaneously applied. For all other display elements in a given row, the write discharge is insufficient to cause any disturbance to the condition of the display elements in the row. One method of implementing a panel according to this scheme is to use a piece of plastic material which is coated on both sides with a conductor, such as copper, and to etch the line patterns on both sides of the plastic material. The result is a double-sided pattern separated by a dielectric sheet which may then be elaminated to either the top or bottom surface of a rectangular tube panel array or a round tube panel array to form the display elements in the panel. Also, the structure can also be produced with a standard multi-layer printed circuit using standard printed circuit board materials to obtain the multi-layered effect required.

One of the features of the present invention is that although there are a total of four conductor lines per display element rather than two conductor lines per display elements as in a conventional X-Y matrix drive system, the present drive system requires only one electrical connection per drive line group and one panel connection per drive line bus out of the basic construction system as opposed to the X-Y matrix which requires a panel connection for each drive line. This means that for any group of drive lines connected according to the present system will significantly lower the number of external connections required to the panel. Thus the increased complexity of the panel is warranted by the significantly reduced complexity of the logic and drive system required for the panel. Part of the implementation of this feature is dependent on the fact that group connections and line connections are made on the panel itself.

In the figures:

FIG. 1 is a tax perspective view of the arrangement of a tubular plasma display panel with a drive system according to the present invention, FIG. 2 is a perspective cut away view of two adjacent display elements of a capillary tube plasma display panel with a drive system according to the present invention, and FIG. 3 is a schematic diagram of drive circuitry according to the present invention.

DESCRIPTION OF THE PREFERRED EMBODIMENT

Figure 1:
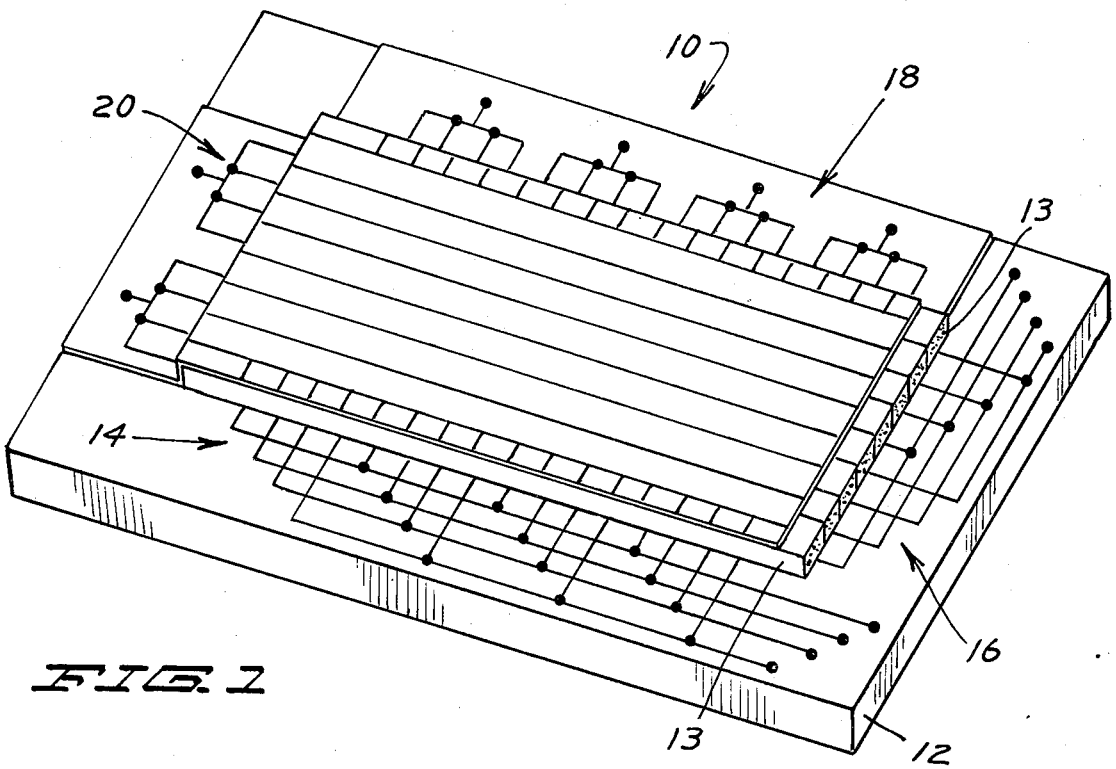

Referring now to FIG. 1, a tubular plasma display panel 10 is shown diagrammatically. The panel consists of a rigid substrate 12, generally comprised of glass, on which an array of thin bottom sustain drive lines 14 are fixed together with an orthogonal array of thin bottom write/erase lines 16. Capillary tubes 13 overlie the bottom arrays of drive conductors. The capillary tubes are shown as rectangular but may be round. They are generally sized at a diameter on the order of a few thousandths of an inch, such as 15 mils. The drive lines may be copper deposited on thin sheets of plastic using printed circuit board techniques. On top of the capillary tubes 13 an array of top sustain drive lines 18 is fixed vertically above the bottom sustain drive lines 14 and parallel thereto. The connections, in matrix arrangement, are organized differently than those to the bottom sustain drive lines, as will be explained. Finally, an array of top write/erase lines 20 is secured over the top sustain drive lines 18. To provide for proper drive electronics these lines are organized differently than the bottom write/erase drive lines, but as with the sustain drive lines, they are arranged parallel to and vertically over the bottom write/erase lines 16.

Figure 2:
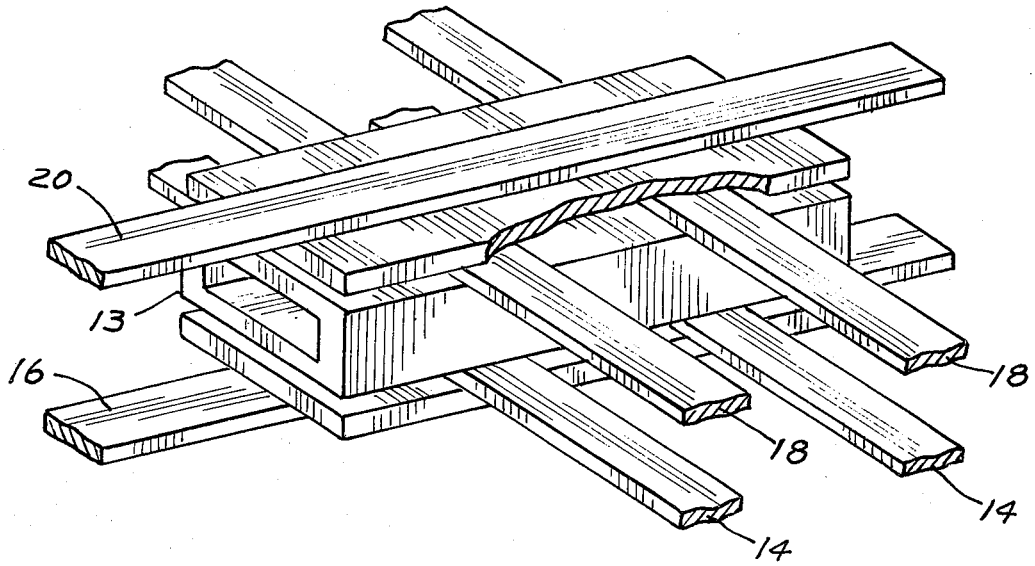

Referring now to FIG. 2, a perspective detail showing is made of a pair of adjacent display elements along a capillary tube 13 in a panel constructed with drive conductors numbered similarly to those of FIG. 1.

Figure 3:
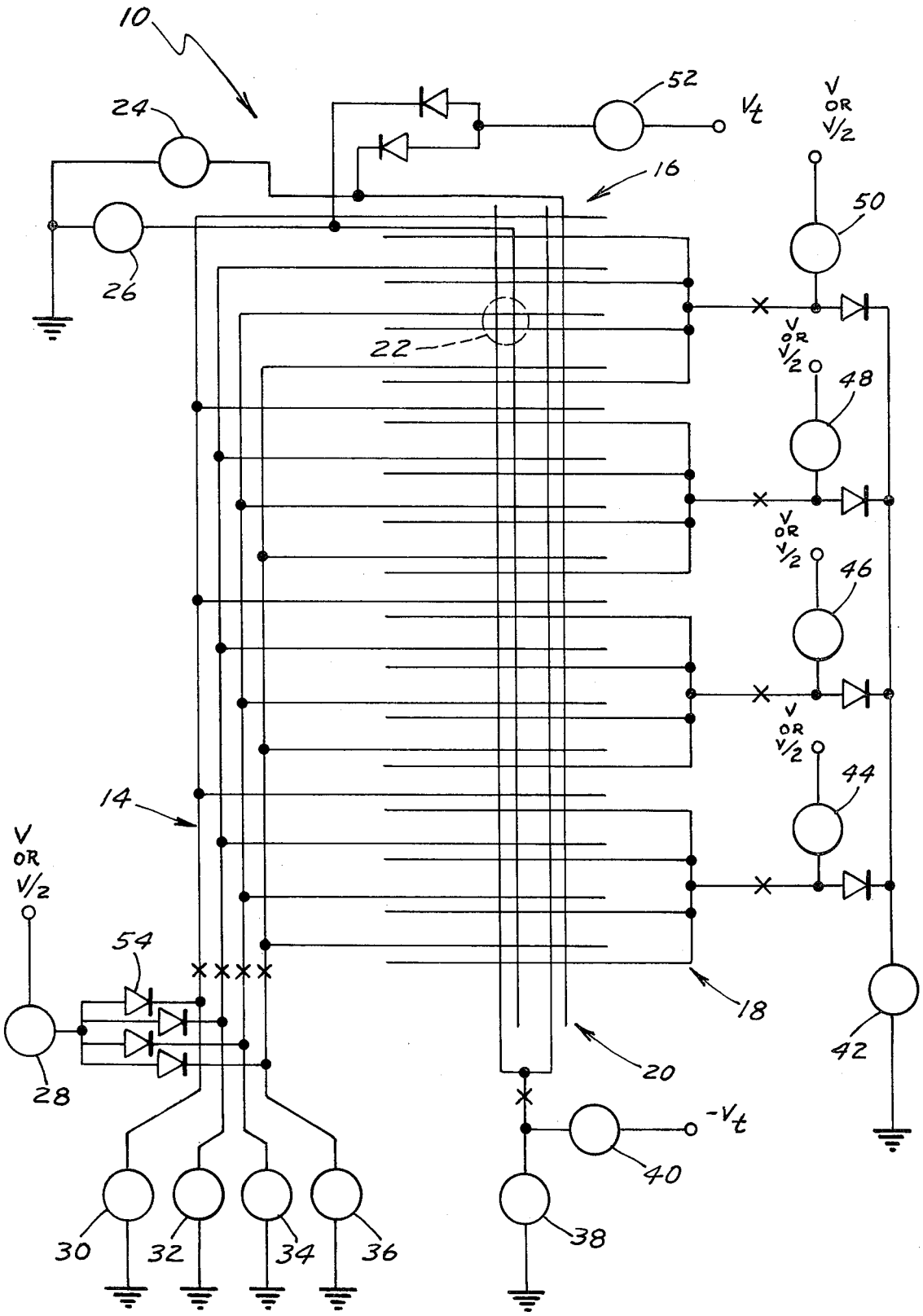

Referring to FIG. 3, a schematic of the drive electronics for a plasma display panel drive system according to the present invention are shown diagrammatically arranged. Parallel conductor lines spaced closely together are for the same row or column of display elements. A typical display element 22 is associated with four different drive lines, a top write/erase line, a top sustain line, a bottom write/erase line and a bottom sustain line.

Voltages on the various drive conductors are controlled by swtiches and voltage sources. Switches are indicated schematically by circles which would typically indicate power switching transistors. Voltage sources are simply direct current voltage sources labeled as such. In FIG. 3, switches 24, 26, 28, 30, 32, 34, 36, 38, 40, 42, 44, 46, 48, 50 and 52 control operation of this illustrative embodiment of the invention. Diodes 54 are shown conventionally and are used to isolate individual conductors by preventing reverse current flow.

The scheme of operation of the drive system may be explained generally as follows. When the panel is being sustained in the conventional fashion, with display elements being neither written or erased, the top and bottom sustain drive lines associated with each respective display element element carry opposite polarity pulses so that each display element will be sustained in either the written or unwritten condition. The top and bottom write/erase lines are not energized during the pure sustain operation. Writing is accomplished by applying an extra positive voltage pulse to a top sustain line associated with a selected display element. This voltage is about one-half the regular sustain voltage pulse. Then the top and bottom write/erase line pair associated with the selected display element is operated so that all display elements associated with the pair are briefly and dimly fired. The are briefly fired in a way that would not change their written or unwritten status in the sequence of sustain pulses. However, the extra pulse received by the selected display element from the top sustain drive line combined with the firing from the write/erase drive line is sufficient to write the selected display element only, so that it is lighted and remains lighted during the sustain waveform. This selected element is written at full brightness because of the addition of the extra pulse.

To erase a written element, a double pulse of the same polarity is applied to the top sustain drive line without an opposite sustain pulse occurring in the bottom sustain line. The erase pulse is of the same voltage as the sustain voltage pulses. The double pulse will not affect unselected element. The selected element is erased because the write/erase drive line pair fires the element in conjunction with the double erase pulse so that the polarity of the display element is reversed from that of all other display elements. Consequently, succeeding sustain pulses will be of the wrong polarity to keep the selected element lighted.

Referring again to FIG. 3, a write sequence will be described for the typical display element 22. First switches 30, 32, 34 and 36 as well as switch 42 are turned on and then off. Then with the electrodes at ground potential, the sustain voltage, V, is changed by the voltage supply to V/2. Then switches 28, 44, 46, 48 and 50 are turned on and then off. The voltage source is then restored to V. Finally switches 34 and 50 are turned on making element 22 ready to fire when a write pulse is fired across it. Switches 26 and 24 operate as clamps so a write pulse is generated by turning on switches 40 and 52 to provide voltage and operating switch 24 to clamp the voltage on the unselected drive line pair. After the write pulse is fired switches 34 and 50 are shut off and the normal sustain pulse train continues, leaving selected element 22 in a written condition. Selected element 22 has the voltage V across it at the time the write pulse occurs while all other elements in the column have either V/2 or 0 voltage.

To erase a selected display element, element 22 for example, the sustain voltage is maintained at the regular sustain level. Switches 30, 32, 34, 36 and 42 are all operated so that the sustain line conductors will be at ground potential, retaining no capacitive charge, and then opened. Then switches 28, 34 and 50 are operated on and then off to create a first voltage pulse at element 22. All conductors are clamped to ground and the the same sequence is repeated to generate a second voltage pulse at element 22 of voltage V. In conjunction with this sequence, the associated write/erase line pair associated with element 22 is operated so that the element fires one extra time reversing its polarity or, in other words, the retained capacitive charge that lingers after each discharge. The sustain pulse wave train is designed to find each element in a particular capacitive polarization and leave it in the same polarization. However, where the polarization has been reversed from normal, the sustain pulses will have no effect and the cell becomes erased.

The panel will typically have a nominal sustain voltage of approximately 250 volts appearing across display elements, a voltage of about 350 for writing display elements and 180–200 for erasing display elements.

What is claimed is:

1. A plasma display element comprising:

an enclosure for containing a gas, an ionizable gas within said enclosure, a first write/erase conductor electrically insulated from said gas and capacitively coupled to said gas through a dielectric, a second write/erase conductor parallel to said first write/erase conductor and electrically insulated therefrom, said conductor electrically insulated from said gas and capacitively coupled to said gas through a dielectric, a first sustain conductor orthogonal to said write/erase conductors and electrically insulated therefrom, said conductor electrically insulated from said gas and capacitively coupled to said gas as through a dielectric, a second sustain conductor parallel to said first sustain conductor and electrically insulated therefrom, said conductor being electrically insulated from said write/erase conductors and electrically insulated from said gas and capacitively coupled to said gas through a dielectric, first electrical drive means associated with said first and second write/erase conductors for placing a predetermined voltage across said conductors in response to a control signal, second electrical drive means associated with said first and second sustain conductors for placing a sustain pulse waveform on said conductors in response to control signals, for placing a predetermined write pulse signal on said conductors in response to control signals, and for placing predetermined erase pulse signals on said conductors in response to control signals.

2. The apparatus of claim 1 wherein a write pulse signal on said sustain conductors causes an extra positive voltage pulse to appear across the display element and wherein the write/erase conductors cause a pulse of the same polarity to appear across the display element as caused by the sustain conductors, said element becoming written by discharging as the sum of the two voltage pulses exceed the firing voltage.

3. The apparatus of claim 1 wherein on an erase pulse signal on said sustain conductors causes a pair of voltage pulses of the same polarity to appear across the display element and wherein the write/erase conductors cause a pulse of sufficient voltage amplitude to appear across the display element in conjunction with said pair of pulses to cause the element to discharge and reverse the polarity of the remaining capacitive charge in the element after firing so that the element will be erased by being of incorrect polarity to be sustained by the normal sustain pulse waveform.

4. A plasma display panel comprising:

an enclosure for containing a gas, an ionizable gas within said enclosure, a plurality of first write/erase conductors electrically insulated from said gas and capacitively coupled to said gas through a dielectric, a plurality of second write/erase conductors parallel to said first write/erase conductor and elecrtrically insulated therefrom, said conductor electrically insulated from said gas and capacitively coupled to said gas through a dielectric, a plurality of first sustain conductors orthogonal to said write/erase conductors and electrically insulated therefrom, said conductor electrically insulated from said gas and capacitively coupled to said gas through a dielectric, a plurality of second sustain conductors parallel to said first sustain conductor and electrically insulated therefrom, said conductor being electrically insulated from said write/erase conductors and electrically insulated from said gas and capacitively coupled to said gas through a dielectric, first electrical drive means associated with said first and second write/erase conductors for placing a predetermined voltage across said conductors in response to a control signal, second electrical drive means associated with said first and second sustain conductors for placing a sustain pulse waveform on said conductors in response to control signals, for placing a predetermined write pulse signals on said conductors in response to control signals, and for placing predetermined erase pulse signals on said conductors in response to control signals.

* * * * *